US009449537B2

(12) United States Patent
Polus et al.

(10) Patent No.: US 9,449,537 B2
(45) Date of Patent: Sep. 20, 2016

(54) DIMENSIONAL DISPLAY SYSTEM

(71) Applicant: Franke Technology and Trademark Ltd., Hergiswil (CH)

(72) Inventors: Dan C. Polus, Thousand Oaks, CA (US); Clifton B. Casipit, Nolensville, TN (US)

(73) Assignee: Franke Technology and Trademark Ltd., Hergiswil (CH)

( * ) Notice: Subject to any disclaimer, the term of this patent is extended or adjusted under 35 U.S.C. 154(b) by 102 days.

(21) Appl. No.: 14/155,706

(22) Filed: Jan. 15, 2014

(65) Prior Publication Data

US 2015/0199925 A1 Jul. 16, 2015

(51) Int. Cl.

| | |
|---|---|
| ***G09F 7/00*** | (2006.01) |
| ***G09F 7/20*** | (2006.01) |
| ***G09F 19/00*** | (2006.01) |
| ***G09F 7/06*** | (2006.01) |
| *G09F 7/18* | (2006.01) |

(52) U.S. Cl.
CPC . *G09F 7/20* (2013.01); *G09F 7/06* (2013.01); *G09F 7/18* (2013.01); *G09F 19/00* (2013.01); *G09F 2007/1804* (2013.01)

(58) Field of Classification Search
CPC ..... G09F 3/06; G09F 3/04; G09F 7/02–7/04
See application file for complete search history.

(56) References Cited

U.S. PATENT DOCUMENTS

| | | | | |
|---|---|---|---|---|
| 3,594,940 | A * | 7/1971 | Yonezawa | A63H 33/04 446/108 |
| 5,039,047 | A * | 8/1991 | Pitzo | 248/206.5 |
| 6,338,215 | B1 * | 1/2002 | Vincent | 40/730 |
| D498,595 | S * | 11/2004 | Gordon | D6/302 |
| 6,889,458 | B2 * | 5/2005 | Copley | 40/711 |
| 8,959,808 | B2 * | 2/2015 | Uno et al. | 40/124.01 |
| 2003/0168569 | A1 | 9/2003 | Simson et al. | |
| 2009/0139127 | A1 * | 6/2009 | Southard | A47G 1/065 40/761 |
| 2010/0229442 | A1 * | 9/2010 | Snow et al. | 40/761 |
| 2012/0169718 | A1 * | 7/2012 | Schindler | 345/419 |

OTHER PUBLICATIONS

U.S. Appl. No. 61/891,747, filed Oct. 16, 2013.

* cited by examiner

*Primary Examiner* — Cassandra Davis
(74) *Attorney, Agent, or Firm* — Volpe and Koenig, P.C.

(57) ABSTRACT

In order to provide a dimensional display system which is easy to use, quick to execute, and inexpensive, the dimensional display system contains a backboard sign, at least one offset sign having a size smaller than the backboard sign, and at least one spacer assembly. The spacer assembly contains a first fastening element, which is adapted to be attached to the backboard sign, and a second fastening element, which is adapted to be attached to the offset sign. The first and second fastening elements form corresponding components of a fastening mechanism to affix the offset sign to the backboard sign at a predefined distance thus creating a three-dimensional effect.

4 Claims, 4 Drawing Sheets

DIMENSIONAL DISPLAY SYSTEM

FIELD OF THE INVENTION

The present invention relates to signs and advertising displays and, more particularly, to a dimensional display system with a backboard sign carrying one or more offset signs spaced apart from the backboard sign to create a three-dimensional effect.

BACKGROUND OF THE INVENTION

Many retailers, such as restaurants, grocery stores, and clothing retailers use display advertisements as part of their marketing strategy to advertise to consumers patronizing their establishments and/or potential consumers in the vicinity. For example, a restaurant may place a display advertisement at its entrance to inform patrons of new menu items. In general, display advertisements may include stand-up displays and other kind of signs or advertising displays with graphics printed thereon such as images, indicia, slogans, or any other kind of texts that conveys an advertising message.

In today's increasingly crowded retail marketplace and the persistent exposure of customers to such advertisements, as well as the number of similar nearby competing messages, it becomes more difficult to capture the attention of consumers with such display advertisements. An efficient way to command attention and create an advertising campaign that stands out would be the use of dimensional displays. A dimensional display uses small graphic panels, which will be fixed to a larger back panel with a spacer that adds relief to create a three-dimensional effect.

Currently, dimensional displays use cardboard tabs or foam blocks to achieve three-dimensional effects by offsetting smaller flat graphic elements from a larger base sign backboard. Both, the cardboard tab and the foam block methods of creating offset are unsightly. Neither holds up well to direct customer physical contact, and neither works well outdoors in wind and rain. In addition, cardboard tabs and foam systems require an inordinate amount of assembly time with very detailed instructions. This results in long learning curve inefficiencies for a single execution at every retail site. Due to all the above, dimensional graphics are not often used in retail settings despite their effectiveness as a point-of-sale element.

SUMMARY OF THE INVENTION

It is therefore an object of the present invention to provide a dimensional display system and a spacer assembly for use with such a dimensional display system, which are easy to use, quick to execute, and inexpensive.

These and other objects that appear below are achieved by a dimensional display system with a backboard sign, at least one offset sign having a size smaller than the backboard sign, and at least one spacer assembly. The spacer assembly contains a first fastening element, which is adapted to be attached to the backboard sign, and a second fastening element, which is adapted to be attached to the offset sign. The first and second fastening elements form corresponding components of a fastening mechanism to affix the offset sign to the backboard sign at a predefined distance.

Preferably, the dimensional display system contains two or more offset signs and two or more spacer assemblies of different lengths to affix the two or more offset signs at different distances to the backboard sign.

Accordingly, the dimensional display system uses specially developed spacers of a various lengths to make assembly of dimensional signs easy and fast.

In an embodiment, the first fastening element, which will be attached to the backboard sign, contains a base plate that carries an offset post of a predefined length. Preferably, the base plate has a shape or indication, which corresponds with a printed shape or indication provided on the backboard sign to indicate a position for the attachment of the base plate. Assembly of the display system would thus be greatly simplified without requiring detailed assembly instructions.

Particularly, if first fastening elements of spacer assemblies of different lengths have base plates with different shapes or other kind of different indications, assembly of even more complex dimensional display systems with multiple levels of dimensionality will become virtually foolproof.

In another embodiment, the backboard sign of the dimensional display system has one or more pre-drilled holes to define positions for the attachments of one or more first fastening elements. Moreover, the first fastening elements have pins that engage with these pre-drilled holes. In this way, the fastening elements can be securely attached to the backboard sign and the accuracy with which the fastening elements will be placed to their predefined positions on the backboard sign is greatly increased. This is particularly useful for larger offset sign elements, which will be fixed to the backboard sign via several spacer assemblies. Since the pre-drills holes will later be covered by the offset signs anyway and will thus not be visible to a customer, they will not interfere with the graphic printed on the backboard sign.

In preferred embodiments, the first and/or second fastening elements are provided with double-sided adhesive tape or foam tape to attach them to the backboard sign and/or offset sign, respectively. Pre-fitted double-sided adhesive tape provides a simple, fast, and secure way of attaching the fastening elements.

In one embodiment, the corresponding components of the fastening mechanism that connects the fastening elements of a spacer assembly can include a snap receptacle and corresponding snap plug.

The inventions further relates to a spacer assembly for use with such a dimensional display system, which includes first and second fastening elements.

The present invention thus provides a dimensional display system, which is easy and fast to assemble, durable, inexpensive, and flexible enough for most creative designs.

BRIEF DESCRIPTION OF THE DRAWINGS

Embodiments of the present invention will now be described with reference to the accompanying drawings, in which.

DETAILED DESCRIPTION OF EMBODIMENTS

Figure 1:
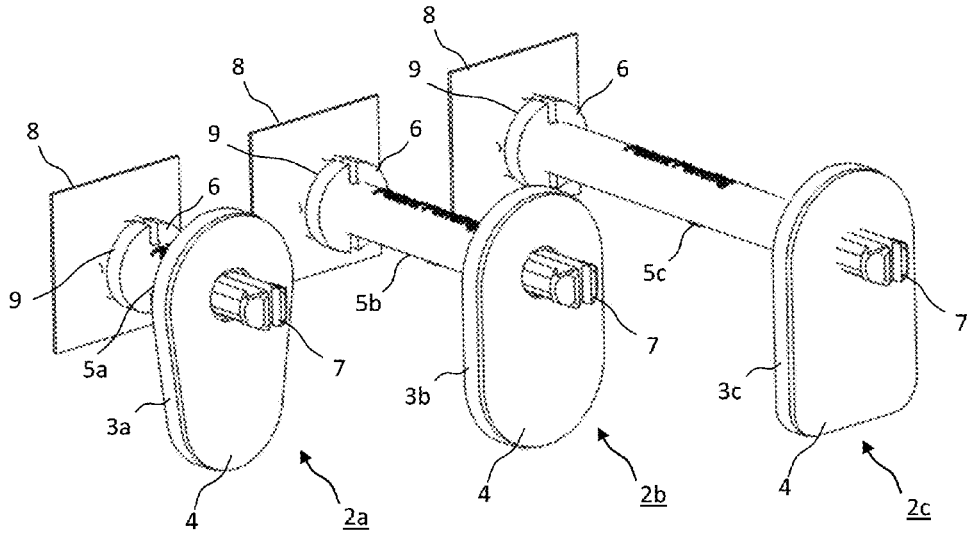
FIG. 1 shows an isometric view of three spacer assemblies of different lengths.
Figure 2:
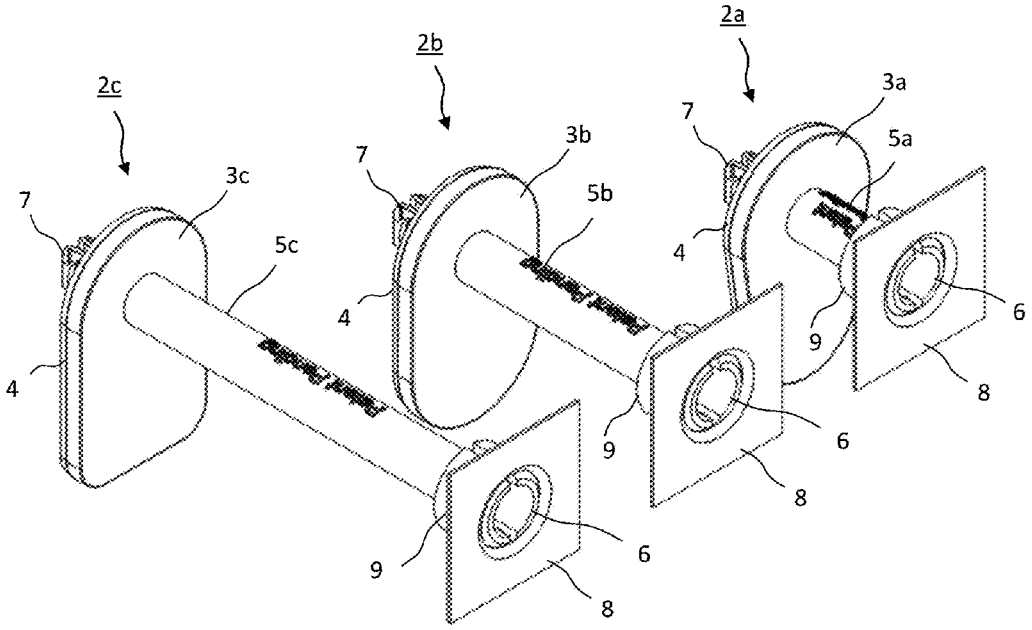
FIG. 2 shows the spacer assemblies of FIG. 1 from a different angle.
Figure 3A:
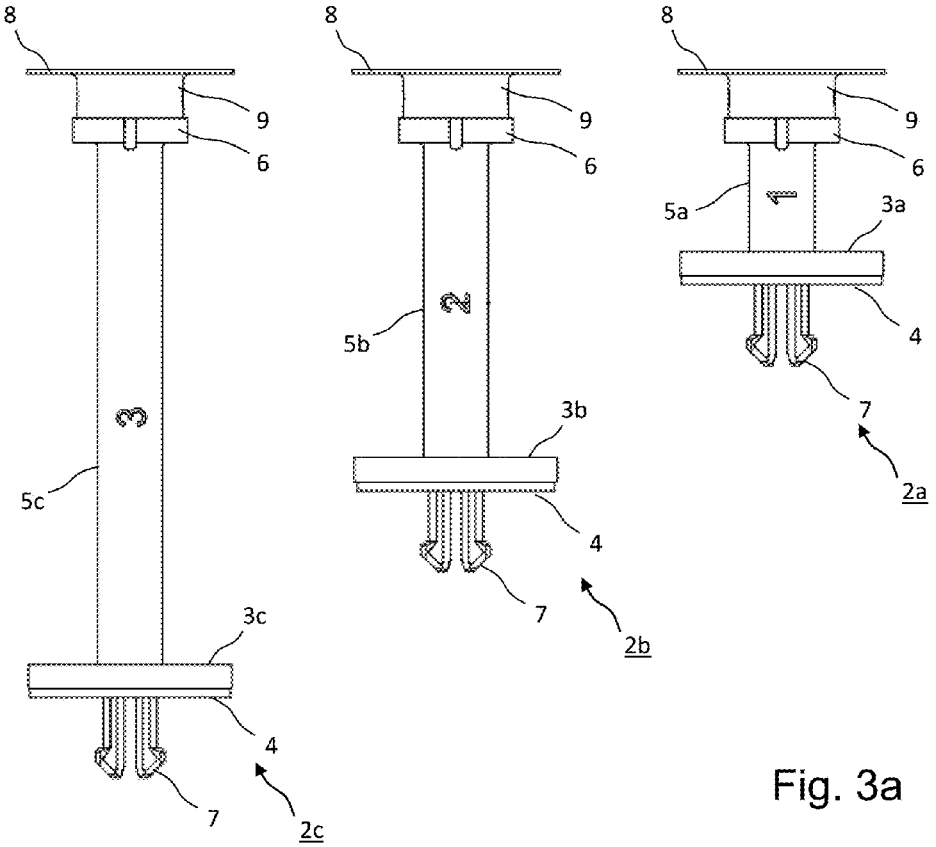
FIGS. 3*a* and 3*b* show front and sight views of the three different-length spacer assemblies from FIG. 1.
Figure 3B:
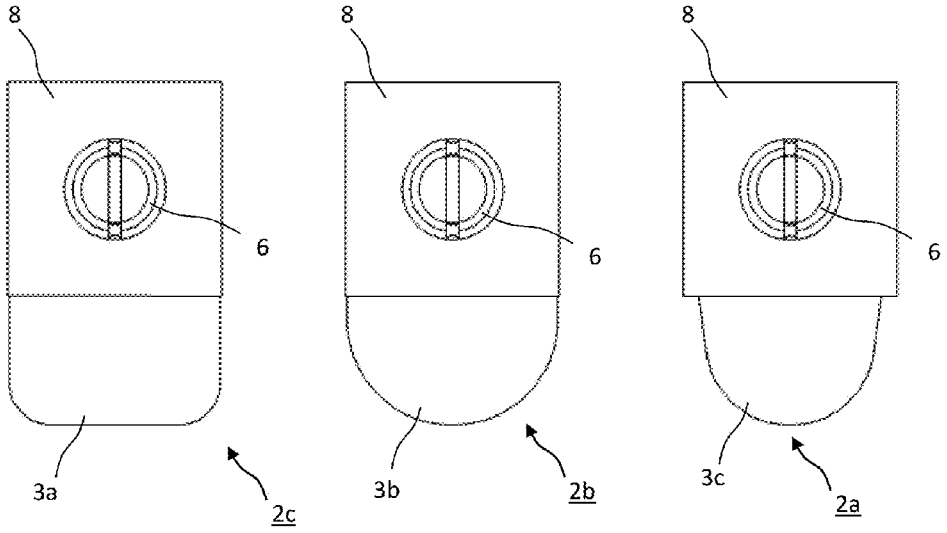

The invention described in this document is not limited to the particular systems and methodologies described, as these may vary. The terminology used herein is for the purpose of describing particular embodiments only, and is not intended to limit the scope of the present disclosure.

It should be understood that as used herein and in the appended claims, the singular form "a", "an", and "the" include plural reference unless the context clearly dictates otherwise. Unless defined otherwise, all technical and scientific terms used herein have the same meanings as commonly understood by one ordinary skill in the art. As used herein, the term "comprising" means "including, but not limited to".

The described technology generally relates to display systems. Display systems as described herein may be used in advertising campaigns without being limited to that purpose. For instance retailers use various point-of-purchase signs to communicate information to consumers patronizing their establishments. Display systems may include for instance advertising signs such as stand-up displays in the form of sandwich boards or snap frames. Stand-up displays, which can be placed on the pavement, are also sometimes referred to as "customer stoppers".

Display systems may be formed from paper-based materials, such as corrugated cardboard, as well as plastic-based materials including corrugated plastic or twin-wall sheets manufactured from PE or PP. Display systems may also include frames, racks, or stands of other materials, including metals or wood.

The embodiments described below relate to dimensional display systems, which achieve a three-dimensional effect through the use of spacers of various lengths to affix smaller size offset signs to a larger size backboard sign. Therefore, embodiments of the invention include special spacer assemblies of various lengths that are used to add relief thus creating the three-dimensional effect. These spacers may include, but are not limited to, easy-to-manufacture and cheap injection-molded plastic parts made for instance from polypropylene (PP), polyethylene (PE) or other synthetic materials.

An embodiment of spacer assemblies of different lengths is shown in FIGS. 1, 2, 3*a*, and 3*b*. As shown there, three different length spacer assemblies 2*a*, 2*b*, 2*c* can be used to affix offset signs to a larger backboard sign.

In the embodiment shown, the three spacer assemblies or offsets 2*a*, 2*b*, 2*c* may have lengths of one inch, two inches, and three inches, respectively. Each of the spacer assemblies 2*a*, 2*b*, 2*c* has a base plate 3*a*, 3*b*, 3*c*, which on one side is covered with a double-sided adhesive foam tape 4. At the other side, an offset post or spacer bar 5*a*, 5*b*, 5*c* extends substantially perpendicular from the respective base plates 3*a*, 3*b*, 3*c*. The offset posts 5*a*, 5*b*, 5*c* carry at their respective ends a snap-in mechanism 6 with two elastic catches, which form a snap-in plug.

Opposite to the offset posts 5*a*, 5*b*, 5*c*, the base plate 3*a*, 3*b*, 3*c* carries a slotted pin 7 which is provided to engage into a pre-drilled hole of a backboard sign. The slotted pin 7 is formed in present embodiment by two elastic catches with retaining lugs, which when pushed through a pre-drilled hole, engage behind the backboard sign.

In an alternative embodiment, the pin can be formed as a simple, straight bolt or prong. The hole in the backboard sign where the pin is inserted into can be made slightly undersized, i.e. with a diameter slightly smaller than the diameter of the pin. When the pin is then pushed through the undersized hole, the natural tension of the surrounding material along with the double stick tape will provide sufficient holding power for the spacer assembly and an offset sign affixed thereto.

Base plates 3*a*, 3*b*, 3*c*, offset posts 5*a*, 5*b*, 5*c*, snap-in mechanism 6, and pin 7 form first fastening elements, adapted to be attached to a backboard sign. As can be seen from the figures, base plates 3*a*, 3*b*, 3*c* of the different lengths spacer assemblies 2*a*, 2*b*, 2*c* have significantly different shapes to allow them to be easily identified and associated with corresponding targets pre-printed on a backboard sign to indicate positions for the attachments of the corresponding fastening element.

A second fastening element of the spacer assemblies 2*a*, 2*b*, 2*c* includes a retaining plate 8 that carries a snap receptacle 9, which forms the corresponding counterpart to the snap-in mechanism 6. When pushed together, the catches of snap-in mechanism 6 engage with the snap receptacle 9 and locked securely into place, thus forming a rigid connection between the two fastening elements.

The retaining plate 8 of the second fastening element is adapted to be attached to an offset sign, for instance by means of double-sided adhesive (foam) tape (not shown), similar to the base plates 3*a*, 3*b*, 3*c* of the first fastening element. It should be understood, that instead of double-sided adhesive tape, any other kind of adhesives, including solvent-based adhesive, thermosetting adhesive (hot glue), or the like, may be used to bond the retaining plate 8 or base plates 3*a*, 3*b*, 3*c*, respectively, to the corresponding sign. Instead of bonding, base plates 3*a*, 3*b*, 3*c* can alternatively be secured by a suitable fixing means from the backside of a backboard sign through pre-drilled holes.

As will be apparent, the first fastening element of the spacer assemblies 2*a*, 2*b*, 2*c* can be attached to the front side of a backboard sign at an appropriately identified target position, the second fastening element can be attached with its retaining plate 8 to the backside of an offset sign, and the offset sign can then be affixed to a backboard sign by locking the two fastening elements of the spacer assemblies 2*a*, 2*b*, 2*c* together. The two-part design of the spacer assemblies 2*a*, 2*b*, 2*c* thus allows an easy, fast, and secure connection between a backboard sign and one or more offset signs at different distances from the backboard sign.

The locking or fastening mechanism between the two fastening elements, which is shown in the embodiment as a snap-in mechanism, can be of various designs and can include mechanical or magnetic connections. The connection between the two fastening elements, once engaged, can be releasable or non-releasable (single-use). For instance the two fastening elements can have at their mutual contact point strong magnets that when brought in contact, magnetically stick together. Alternatively, a magnetic connection can be formed between a magnet at one of the fastening elements and a ferromagnetic metal part at the other. Similarly different designs for mechanical plug mechanisms can be thought of and are generally known in the art, per se, which can be used to connect the fastening elements It should be understood that instead of or in addition to printed targets, which sketch the outer shape of a corresponding base plate, other indications can be used to identify the appropriate fastening element. For instance, numerals or other reference signs, which identify a fastening element of appropriate length can be shown thereon and printed at the corresponding position on the backboard sign, such as numerals 1, 2, and 3 on the offset posts 5*a*, 5*b*, 5*c* in FIG. 3*a*.

Figure 4:
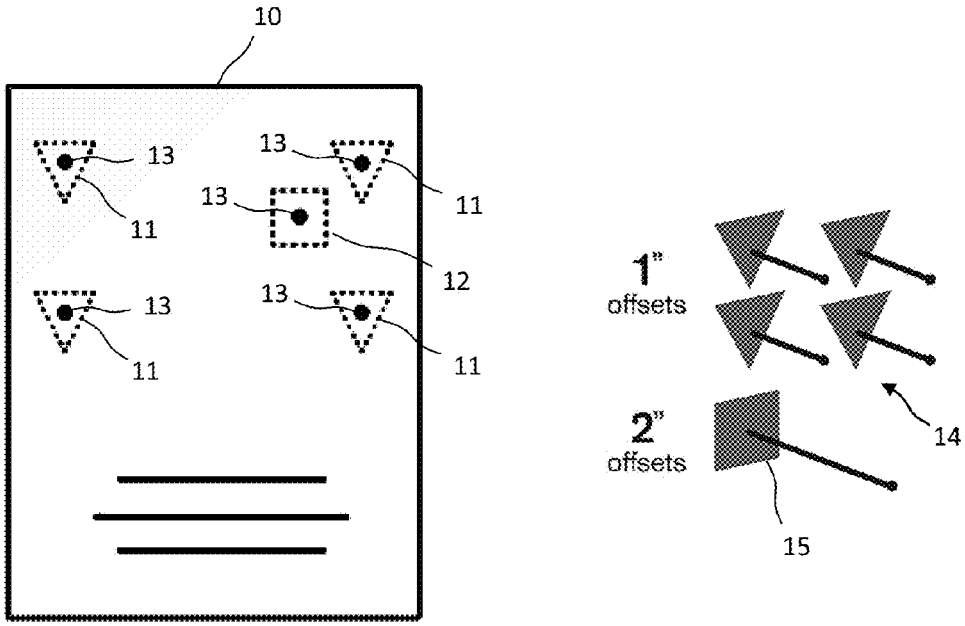
FIG. 4 shows an embodiment of a dimensional display system with a backboard sign and two offset signs.
Figure 4:
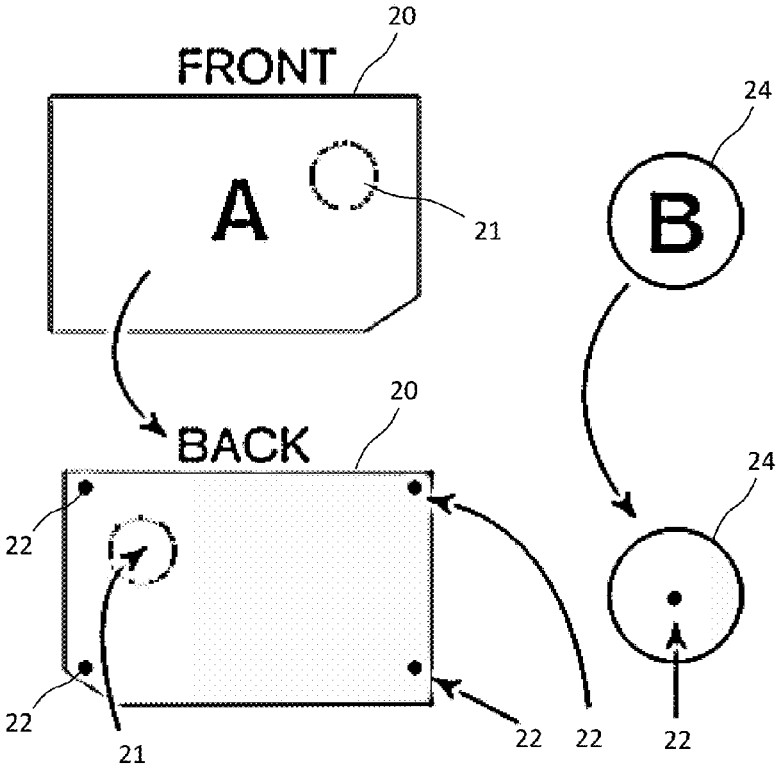

A simple embodiment of a display system is shown in FIG. 4. It contains a backboard sign 10, a first medium size offset sign 20 and a second smaller size offset sign 24, as well as a set of spacer assemblies or offsets 14, 15. Typically the system ships in the form of a flat and unassembled kit and needs to be assembled by some personnel at the retail site. The backboard sign 10 shows a base graphic and has a number of printed targets 11, 12 on its front side, which identify the positions for the different length offsets. Pre-drilled holes 13 are provided within the printed targets to allow the pin at the back of the base plate of the respective offset 14, 15 to engage therein. The set of offsets 14, 15 contains four one inch offsets 14, which have a triangular base plate, and one two inch offset 15 with a rectangular base plate. Accordingly, backboard sign 10 has four triangular targets 11 and one rectangular target 12 printed on its front side.

The offset signs 20 and 24 also show smaller graphics (indicated through letters A and B) and are of different shapes. By way of example, offset sign 20 is shown with a rectangular shape with one corner cut off, and offset sign 24 is shown to have a circular shape. It should be understood, however, that the shown embodiment is of schematic nature and the shapes of offset signs 20, 24 are roughly simplified. In real embodiments, the offset signs 20, 24 can have any arbitrary shape. For example in the case of a fast-food restaurant, an offset sign may have the shape of a burger and a box of French fries. In the embodiment shown, offset sign 20 also has a circular opening 21, which purpose is to allow the two inch offset 15 to extend through offset sign 20 and thus create a second level of dimensionality.

The flipside of offset signs 20, 24 is shown in FIG. 4 further below. As schematically indicated, snap receptacles 22 are pre-fitted at appropriate positions to allow the offset signs 20, 24 to be attached to offsets 14, 15. As will be apparent to those skilled in the art, offset signs 20, 24 can be shipped with pre-fitted snap receptacles 22, or the receptacles, which form the second fastening elements of the spacer assemblies, can be attached and bonded to appropriately marked positions (targets) at a flipside of the offset signs 20, 24 at the time when the display system is finally assembled through some personnel of the retailer.

Figure 5:
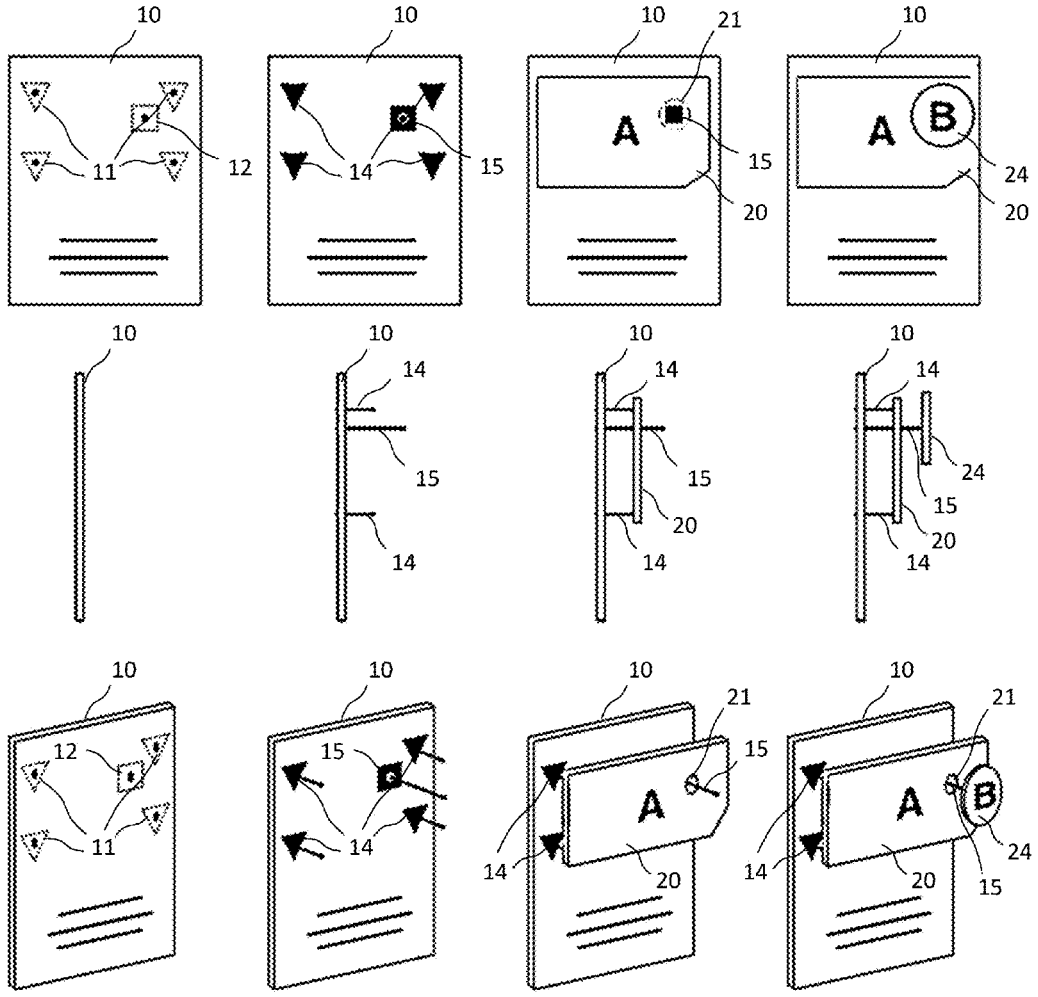
FIG. 5 shows different assembly steps of the dimensional display system from FIG. 4 in front, side and isometric views.

Assembly of the display system as such is rather simple. FIG. 5 indicates the individual assembly steps. In FIG. 5, the first row of sketches shows the front view of the display system after the various assembly steps, the second row of sketches shows a side view, and the third row of sketches shows a corresponding perspective view of the display system after each of the various assembly steps.

In a first step, shown in the first column of sketches, the backboard sign 10 is laid flat on a workspace with the printed targets facing upwards.

In a second step, shown as the second column of sketches, the four one-inch offsets 14 and the one two-inch offset 15 will be installed in correct position per targets on the backboard sign 10. To do this, the user simply peels off the backing paper from the double-sided adhesive tape at the back of the based plate of the corresponding offset 14, 15, engages the pin at the rear side of the corresponding offsets into the appropriate pre-drilled hole 13, and presses the offsets 14, 15 against the backboard sign 10.

In a third step, shown as third column of sketches, the user snaps the first dimensional element "A", i.e. offset sign 20, on to the one inch offsets 14, i.e. the ones with the triangular base plate. The somewhat longer two-inch offset 15 will now extend through the circular opening 21 of offset sign 20.

In a last step, shown in the fourth column of sketches, the user will finally snap the dimensional element "B", i.e. the smaller offset sign 24, on to the two-inch offset 15. Assembly of the display system is now finished, and the display system is ready to be put up at the premises of the retailer.

As can be seen, assembly of the display system is particularly simple and can be executed even by an unskilled user without having to read through a detailed instruction manual, first. The large base graphic, i.e. the backboard sign 10, has holes pre-drilled where offsets are inserted by the user. Printed targets on the graphic indicate what size offset is to be used in each hole. The user has just to peel back the double-stick on the base of an offset, insert the appropriate length offset into each hole as dictated by the printed information on the base graphic, align the snap receptacles on the back of the smaller offset graphics with the offset stamps and press firmly to connect the two and create dimensionality for the sign. The smaller offset graphics may include pre-positioned snap receptacles on the flipside of the graphic, which are pre-installed at the factory. Alternatively, the snaps can be installed by the user in the same way as the offset stamps on the base graphic, at the time he assembles the display.

Description and drawings merely illustrate the principles of the invention. It will thus be appreciated that those skilled in the art will be able to devise various arrangements that, although not explicitly described or shown herein, embody the principle of the invention and are included within its spirit and scope. Furthermore, all examples recited herein are principally intended expressly to be only for pedagogical purposes to aid the reader in understanding the principles of the invention and the concepts contributed by the inventors to furthering the art, and are to be construed as being without limitation to such specifically recited examples and conditions. Moreover, all statements herein reciting principles, aspects, and embodiments of the invention, as well as specific examples thereof, are intended to encompass equivalence thereof.

What is claimed is:

1. A dimensional display system comprising a backboard sign, two or more offset signs having a size smaller than said backboard sign, and two or more spacer assemblies, said spacer assemblies comprising first fastening elements that are all attachable to said backboard sign and second fastening elements that are attachable to said offset signs, wherein said first and second fastening elements form corresponding components of a fastening mechanism to affix said offset signs to said backboard sign at a predefined distance, wherein said two or more spacer assemblies are of different lengths and affix said two or more offset signs at different distances to said backboard sign and said corresponding components of said fastening mechanism comprise a snap receptacle and corresponding snap catches, wherein each of said first fastening elements comprises a base plate and an offset post of one of a set of different predefined lengths carried by said base plate, and wherein said base plate has a shape or indication, which corresponds with a printed shape or indication provided on said backboard sign to indicate a position for the attachment of said base plate.

2. A dimensional display system according to claim 1, wherein the first fastening elements of said spacer assemblies have base plates with different shapes or indications.

3. A dimensional display system according to claim 1, wherein said backboard sign has one or more pre-drilled holes to indicate positions for the attachment of one or more of the first fastening elements, and wherein said first fastening elements have pins designed to engage with said pre-drilled holes.

4. A dimensional display system according to claim 1, wherein at least one of said first or second fastening elements are provided with double-sided adhesive tape to attach to said backboard sign and/or offset sign, respectively.

* * * * *